US008294343B2

(12) United States Patent
Passman et al.

(10) Patent No.: US 8,294,343 B2
(45) Date of Patent: Oct. 23, 2012

(54) METHOD OF PRODUCING A SPARK PLUG VIA FLARED TIP ATTACHMENT

(75) Inventors: Eric P. Passman, Piscataway, NJ (US); Jeffrey T. Boehler, Holland, OH (US); Matthew B. Below, Findlay, OH (US)

(73) Assignee: Fram Group IP LLC, Auckland (NZ)

( * ) Notice: Subject to any disclaimer, the term of this patent is extended or adjusted under 35 U.S.C. 154(b) by 321 days.

(21) Appl. No.: 12/650,821

(22) Filed: Dec. 31, 2009

(65) Prior Publication Data

US 2010/0164352 A1 Jul. 1, 2010

Related U.S. Application Data

(60) Provisional application No. 61/141,825, filed on Dec. 31, 2008.

(51) Int. Cl.
*H01T 13/20* (2006.01)
*F02M 57/06* (2006.01)

(52) U.S. Cl. ..... 313/141; 313/118; 313/142; 313/144

(58) Field of Classification Search ..... None
See application file for complete search history.

(56) References Cited

U.S. PATENT DOCUMENTS

| | | | |
|---|---|---|---|
| 7,030,544 | B2 | 4/2006 | Yamanaka |
| 7,190,106 | B2 | 3/2007 | Downs et al. |
| 7,323,811 | B2 | 1/2008 | Tinwell et al. |

*Primary Examiner* — Natalie Walford
(74) *Attorney, Agent, or Firm* — Barnes & Thornburg LLP

(57) ABSTRACT

A side electrode for a spark plug is provided. The side electrode includes a side wire having a first end and a second end; an opening proximate to the first end, the opening extending from a first surface of the side wire to a second surface of the side wire, wherein the first surface has a flared portion proximate to the opening; and an electrode tip secured to the first end of the side wire, the electrode tip having a tip portion and a shaft portion, wherein the tip portion is located on the second surface and the shaft portion is secured to the side wire by engaging the flared portion.

18 Claims, 7 Drawing Sheets

METHOD OF PRODUCING A SPARK PLUG VIA FLARED TIP ATTACHMENT

CROSS-REFERENCE TO RELATED APPLICATIONS

This application claims the benefit of U.S. Provisional Application, Ser. No. 61/141,825,filed on Dec. 31, 2008, the contents of which are incorporated by reference herein.

BACKGROUND

A known failure mechanism for spark plugs in combustion engines is the failure of the ground or side electrode due to service in oxidizing conditions and at elevated temperatures. Currently, a sphere of precious metal alloy is resistance welded to the Ni-based super alloy ground electrode. This tip and weld is often the nucleation point for failure. Spark plug failure can result from poorer spark erosion resistance due to oxidation of the electrode, scale formation resulting in increased spark resistance, and oxidation of the electrode-tip interface leading to increased spark resistance or the tip falling off. Cost savings is also a driving force. By improving the weld interface and/or using a more erosion resistant tip material, one can increase the spark plug life. However, better tip materials have been shown to cause resistance welding difficulties.

Standard spark plugs are manufactured by welding a precious metal or precious metal alloy tip to a ground electrode of some base material (typically nickel-based alloy). The precious metal tip composition is such that it can be welded to the base side electrode material. However, this weld can fail due to several causes, some of which were previously mentioned. Also, some tip materials (such as iridium and iridium based alloys), which have been shown to perform better in spark plug applications than the current practice of platinum-based alloys, are extremely difficult to weld resistively.

Accordingly, it is desirable to provide a side electrode for spark plugs designed to have a side wire/electrode tip attachment that is less susceptible to failure and has an electrode tip formed from erosion resistant tip materials.

SUMMARY

In one exemplary embodiment, a side electrode for a spark plug is provided. The side electrode includes a side wire having a first end and a second end; an opening proximate to the first end, the opening extending from a first surface of the side wire to a second surface of the side wire, wherein the first surface has a flared portion proximate to the opening; and an electrode tip secured to the first end of the side wire, the electrode tip having a tip portion and a shaft portion, wherein the tip portion is located on the second surface and the shaft portion is secured to the side wire by engaging the flared portion.

In another exemplary embodiment, a side electrode for a spark plug is provided. The side electrode includes a side wire having a first end and a second end; an opening proximate to the first end, the opening extending from a first surface of the side wire to a second surface of the side wire, wherein the first surface has a flared portion proximate to the opening; and an electrode tip secured to the first end of the side wire, the electrode tip having a first member and a second member, the first member and the second member each having a tip portion and a shaft portion, wherein the tip portion of second member is located on the second surface and the tip portion of the first member is secured to the side wire by engaging the flared portion.

In yet another exemplary embodiment, a side electrode for a spark plug is provided. The side electrode includes a side wire having a first end and a second end; an opening proximate to the first end, the opening extending from a first surface of the side wire to a second surface of the side wire, wherein the first surface has a flange portion proximate to the opening, a flared portion formed adjacent to the flange portion, the flared portion is located proximate to the opening; an electrode tip secured to the first end of the side wire, the electrode tip having a tip portion and a shaft portion, wherein the tip portion is located on the second surface and the shaft portion is secured to the side wire by engaging the flared portion; and a side wire element inserted into the flange portion and secured to the electrode tip.

In another exemplary embodiment, a spark plug is provided. The spark plug includes an insulator shell; a center electrode disposed in the insulator shell such that one end of the center electrode protrudes from the insulator shell; a metal shell exterior to the insulator shell; a side electrode having a side wire with a first end coupled to the metal shell and a second end facing the protruding end of the center electrode forming a spark discharge gap therebetween, an opening proximate to the first end of the side wire, the opening extending from a first surface of the side wire to a second surface of the side wire, wherein the first surface has a flared portion proximate to the opening; and an electrode tip secured to the first end of the side wire, the electrode tip having a tip portion and a shaft portion, wherein the tip portion is located on the second surface and the shaft portion is secured to the side wire by engaging the flared portion.

In another exemplary embodiment of the present invention, a method for fabricating a side electrode for spark plugs is provided. The method includes forming an opening in a side wire having a first end and a second end, the opening formed proximate to the first end and extending from a first surface of the side wire to a second surface of the side wire; forming a flared portion on the first surface proximate to the opening; and securing an electrode tip to the first end of the side wire, the electrode tip having a tip portion and a shaft portion, wherein the tip portion is located on the second surface and the shaft portion is secured to the side wire by engaging the flared portion.

BREIF DESCRIPTION OF DRAWINGS

DESCRIPTION OF EXEMPLARY EMBODIMENTS

Exemplary embodiments of the present invention are directed to a side electrode designed to have a side wire/electrode tip attachment that is less susceptible to failure. This side electrode design for spark plugs allows an electrode tip to be secured to a side wire with or without the aid of welding. Exemplary embodiments of the present invention are also directed to a side electrode having an electrode tip (e.g., rivet, cylinder, sphere of a metal, etc.) being formed from one or a combination of erosion resistant tip materials. More specifically, the electrode tip in accordance with exemplary embodiments of the present invention is formed from at least one or more precious metals, precious metal alloys, base metals or a combination thereof. Exemplary embodiments of the present invention are also directed to a spark plug incorporating the side electrode and a method of fabricating or assembling the same.

In accordance with an exemplary embodiment of the present invention, flaring a side wire would allow an electrode tip (rivet/cylinder/etc.) to be inserted into an opening (with the flared portion on a side opposite the center electrode of a spark plug) that can be made by cutting, stamping, or drilling into the side wire, in which the shaft portion of the electrode tip would be inserted. The end of the electrode tip opposite the center electrode (shaft portion) is impacted with an impacting device having a point (or other shape) in order to expand the shaft portion of the electrode tip to wedge it into place or engage it to the flared portion at a surface of the side wire. Optionally, the other side of the electrode tip (tip portion) near the center electrode is coined or impacted to ensure the electrode tip is locked in placed.

Figure 1:
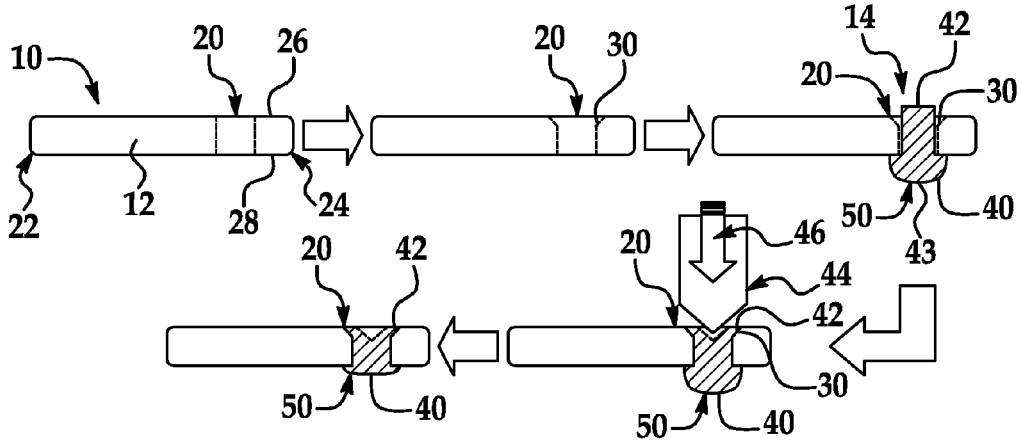
FIGS. 1-3 are side views of a side electrode with a flared rivet tip in accordance with an exemplary embodiment of the present invention.

Referring now to FIGS. 1-18, a side electrode 10 is shown according to exemplary embodiments of the present invention. As shown in FIG. 1, the side electrode 10 generally comprises a side wire 12 and an electrode tip 14 being secured to the side wire 12 through one or more means as described herein. In exemplary embodiments, the electrode tip 14 comprises a rivet, a two-part rivet, dual rivet, a cylinder, or a sphere of metal.

In accordance with one exemplary embodiment, the side wire 12 has an opening 20 for receiving the electrode tip 14. In accordance with one non-limiting exemplary embodiment, the opening 20 has a diameter close to that of the diameter of the narrow end/shaft of the electrode tip 14. The side wire 12 has a first end 22 and a second end 24. The opening 20 is proximate to the second end 24 of the side wire 12 and extends from a first surface 26 of the side wire 12 to a second surface 28 of the side wire 12. The first surface 26 of the side wire 12 has a flared portion 30 proximate to the opening 20 as shown. In accordance with one exemplary embodiment, cutting, stamping, and/or drilling into the side wire 12 can form the opening 20 and the flared portion 30 of the side wire 12.

The side wire 12 is formed from one or more various types of super alloys, such as nickel-based alloys. Of course, other materials or a combination of materials can be used to form the side wire 12 and should not be limited to the example set forth herein.

In accordance with one exemplary embodiment, the electrode tip 14 has a tip portion 40 and a shaft portion 42. The tip portion 40 has a head portion 43. The shaft portion 42 is inserted into the opening 20 from the second surface 28 such that the shaft portion ends up at the flared portion 30 of the side wire 12 and the head of the tip portion 40 is facing the center electrode of a spark plug, in which the side electrode 10 is incorporated into. In other words, the tip portion 40 of the electrode tip 14 is located on the second surface 28 of the side wire 12 and the shaft portion 42 is located at the flared portion 30 of the side wire 12 when the shaft portion 42 is inserted in the opening. The shaft portion 42 of the electrode tip 14 is secured to the side wire 12 by engaging the flared portion 30 as shown. In accordance with one embodiment, the shaft portion 42 of the electrode tip 14 is secured to the side wire 12 and engaged to flared portion 30 by impacting the shaft portion 42 in the flared portion utilizing an impact device 44 that is impacted by a force, which is indicated by arrow 46.

The impact device 44 is an impact head of variable cross-section geometry. The impact device 44 impacts the shaft portion 42 in the flared portion expanding an end of the shaft portion 42 in the flared portion 30 and wedging the shaft portion 42 into place. In accordance with one exemplary embodiment, the impact device 44 is configured to create a wedge shaped cross-section the end of the side electrode (the shaft portion) facing away from the center electrode during impact. Of course the shape formed at the shaft portion 42 can vary depending on the cross-section geometry of the impact head.

Figure 2:
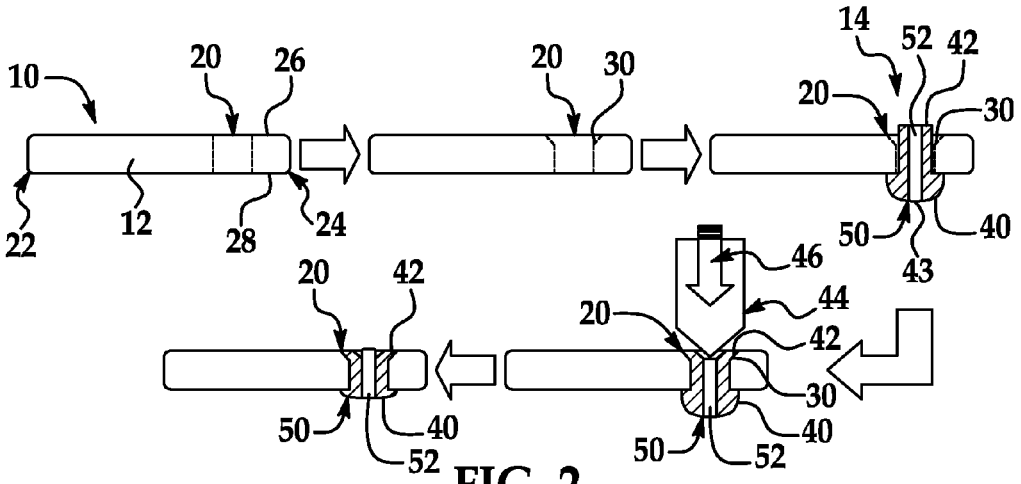
Figure 3:
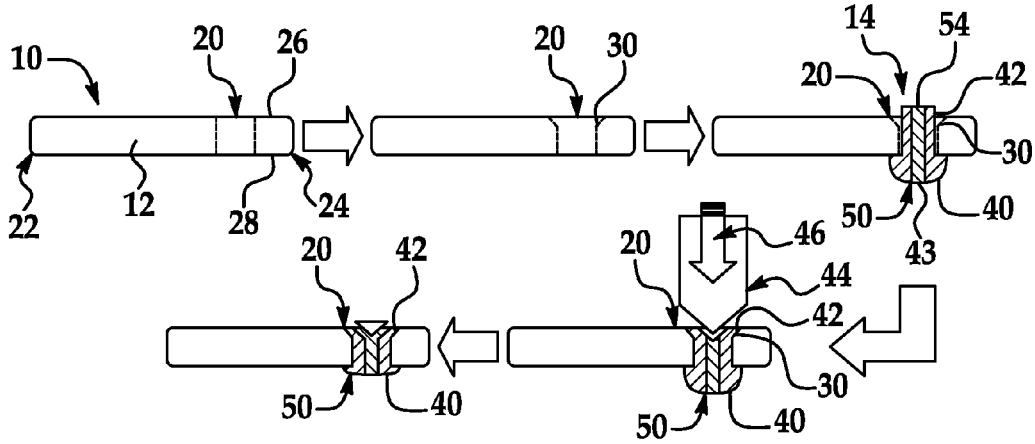

In accordance with one exemplary embodiment, the electrode tip 14 comprises a rivet 50 as shown in FIGS. 1-3. In accordance with one exemplary embodiment, the rivet 50 is formed from at least one precious metal, precious metal alloy, base metal or a combination thereof. For example, rivet 50 may comprise of nickel, platinum, tungsten, iridium and/or rhodium. Of course, other combinations of metals and/or metal alloys can be used to form rivet 50. In accordance with one exemplary embodiment, the rivet 50 includes a hollow core 52 as shown in FIG. 2. This would decrease the amount of precious metal required to form rivet 50. The size of the hollow core 52 can vary depending on the application and should not be limited to the size as shown.

In accordance with one exemplary embodiment, the rivet 50 may also comprises an additional material, such as clad. In other words, at least a portion of the rivet 50 is formed from a clad material. For example, rivet 50 may have clad portions (indicated by reference numeral 54) integrally formed or co-extruded with the other portion(s) of the rivet 50, which can be formed from one or a combination of metals (precious metals, precious metal alloys, base metals), in accordance with one exemplary embodiment. The use of clad will decrease the amount of precious metal required to form rivet 50. Clad can be formed on the outside or inside of the precious metal rivet 50 depending on the application as shown in FIG. 3. In accordance with one exemplary embodiment, the head 43 of the tip portion 40 is coined to ensure the rivet 50 is locked in place.

Figure 4:
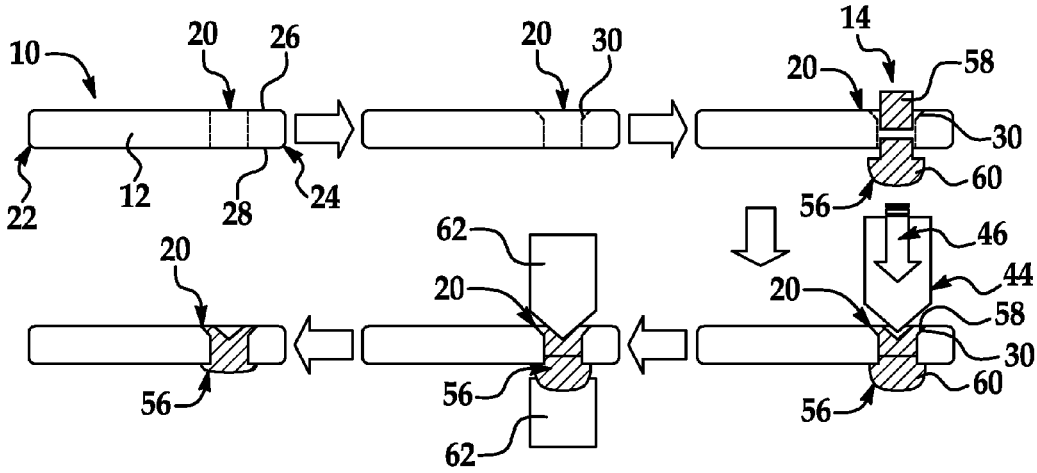
FIGS. 4-6 are side views of the side electrode with a two-piece rivet assembly tip in accordance with an exemplary embodiment of the present invention.
Figure 5:
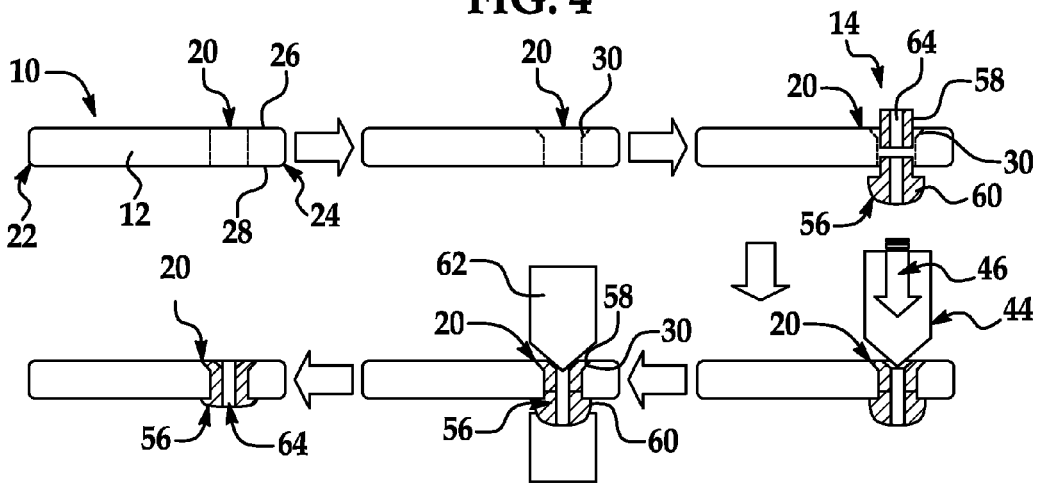
Figure 6:
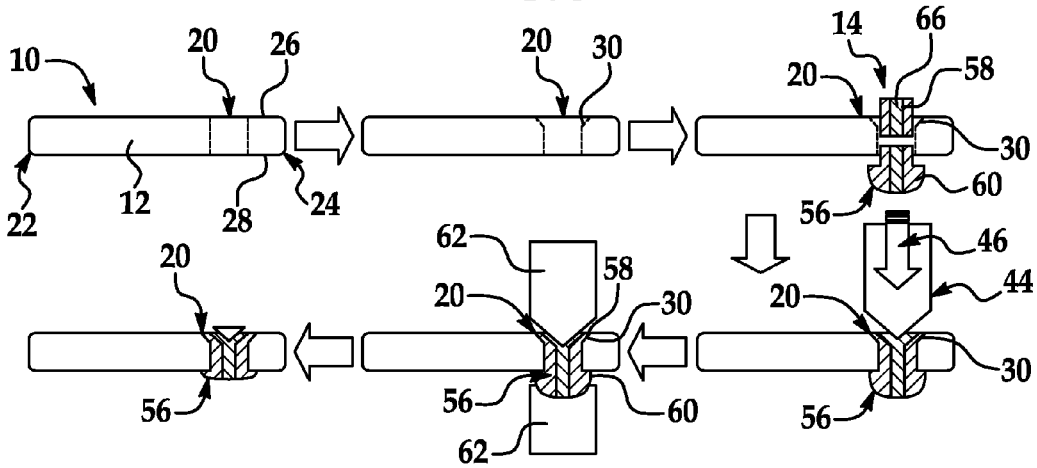

In accordance with an alternative exemplary embodiment of the present invention, the electrode tip 14 comprises a two-part rivet 56 as shown in FIGS. 4-6. In this embodiment, the two-part rivet 56 comprises a first member 58 and a second member 60 making up the shaft portion of rivet 56 and the tip portion of rivet 56 respectively. The two-part rivet 56 is generally rivet 50 cut through the shaft perpendicular to the shaft wall. In this embodiment, the first member 58 is inserted into opening 20 at the flared portion 30 of the side wire 12 and the end of the second member 60 opposite its head portion is inserted into the opening 20 proximate the second surface 28 of the side wire 12. Moreover, the first member 58 is secured to the second member 60 by a resistance-welding device 62 in accordance with one exemplary embodiment. Of course, other means for securing the first member to the second member can be used in other exemplary embodiments of the present invention. In accordance with one exemplary embodiment, the head portion of the second member 56 is coined to ensure the two-part rivet is locked in place.

The first member 58 and/or the second member 60 of the rivet can be formed from at least one precious metal, precious metal alloy, base metal or a combination thereof. For example, the first member 58 and the second member 60 can each comprise of nickel, platinum, tungsten, iridium and/or rhodium. Of course, other combinations of metals and/or metal alloys can be used to form the first member 58 and/or the second member 60 of the two-part rivet. In accordance with one exemplary embodiment, the first member 58 and the second member 60 each includes a hollow core 64 as shown in FIG. 5. This would decrease the amount of precious metal required to form the two-part rivet. The size of the hollow core 64 can vary depending on the application and should not be limited to the size as shown.

In accordance with one exemplary embodiment, the first member 58 and/or the second member 60 may also comprise an additional material, such as clad. In other words, at least a portion of the first member 58 and/or the second member 60 is formed from a clad material. For example, the first member 58 and/or the second member 60 may have clad portions (indicated by reference numeral 66) integrally formed or co-extruded with the other portion(s) of the first member 58 and/or the second member 60, which can be formed from one or a combination of metals (precious metals, precious metal alloys, base metals), in accordance with one exemplary embodiment. The use of clad will decrease the amount of precious metal required to form the two-part rivet 56. Clad can be formed on the outside or inside of the first member 58 and/or the second member depending on the application as shown in FIG. 6.

Figure 7:
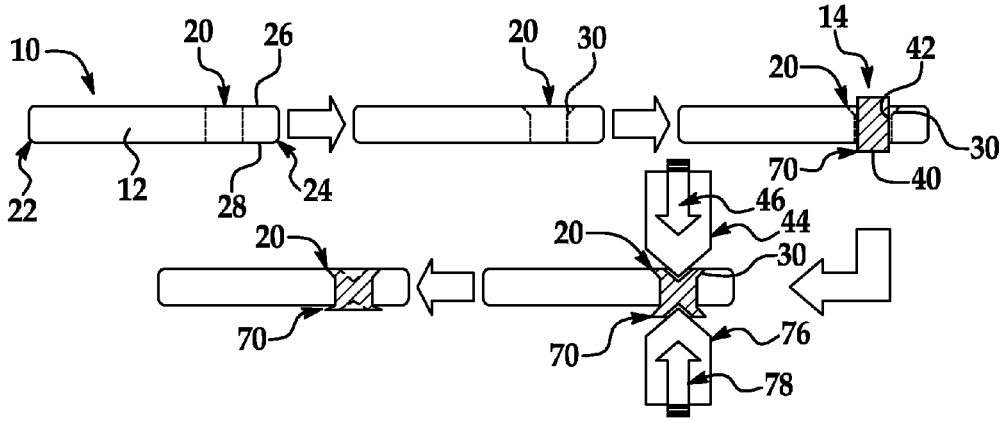
FIGS. 7-9 are side views of the side electrode with a cylinder tip in accordance with an exemplary embodiment of the present invention.
Figure 8:
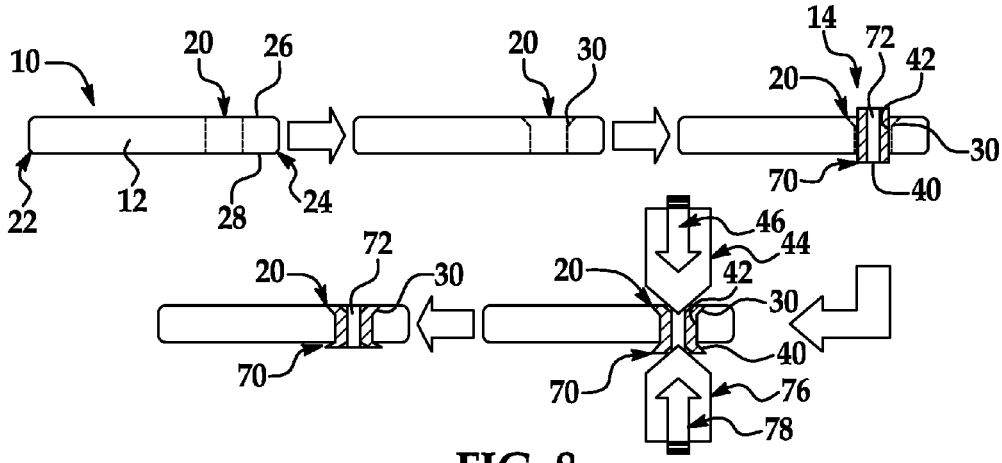
Figure 9:
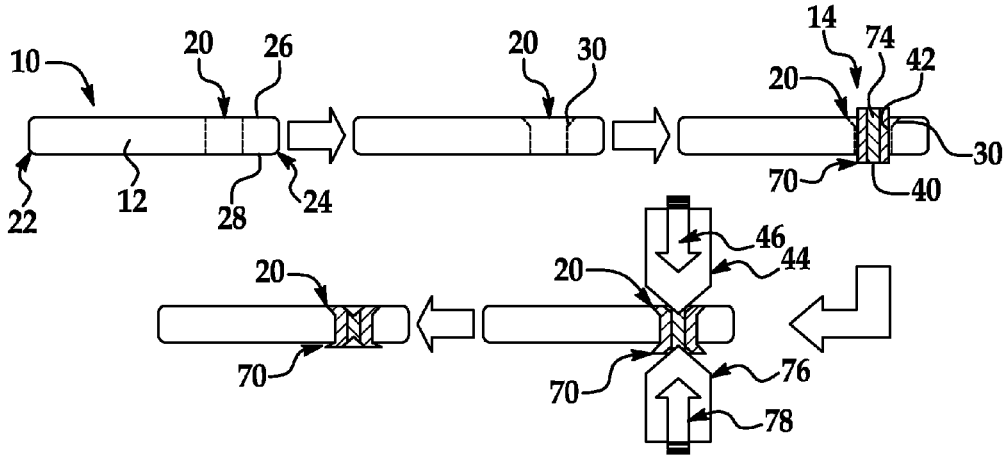
Figure 10:
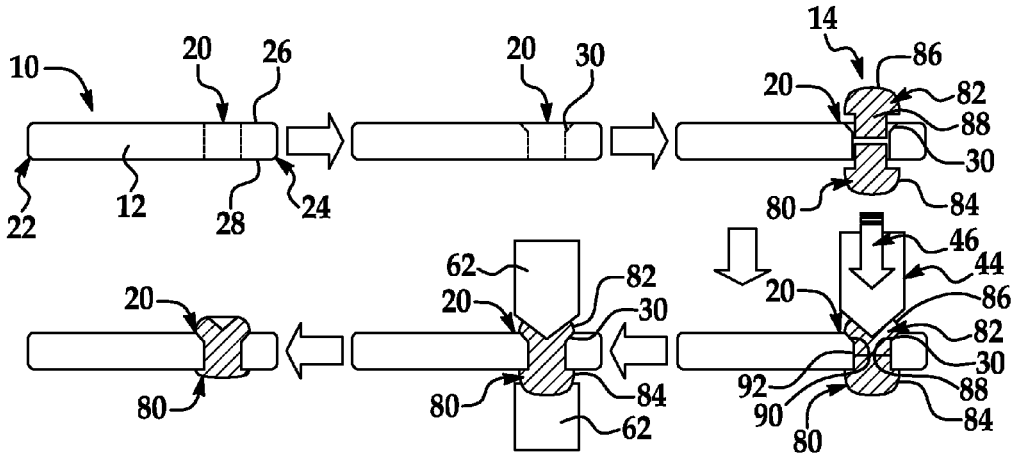
FIGS. 10-12 are side views of the side electrode with a dual rivet assembly tip in accordance with an exemplary embodiment of the present invention.

In accordance with another alternative exemplary embodiment of the present invention, the electrode tip 14 comprises a cylinder 70. The cylinder 70 as the electrode tip can be easier and cheaper to produce than a rivet. Various embodiments of the electrode tip 14 as a cylinder 70 are shown in FIGS. 7-9. In accordance with one exemplary embodiment, the cylinder 70 is formed from at least one precious metal, precious metal alloy, base metal or a combination thereof. For example, cylinder 70 can comprise of nickel, platinum, tungsten, iridium and/or rhodium. Of course, other combinations of metals and/or metal alloys can be used to form cylinder 70. In accordance with one exemplary embodiment, the cylinder 70 includes a hollow core 72 as shown in FIG. 8. This would decrease the amount of precious metal required to form cylinder 70. The size of the hollow core 72 can vary depending on the application and is not limited to the size as shown.

In accordance with one exemplary embodiment of the present invention, cylinder 70 may also comprise an additional material, such as clad. In other words, at least a portion of the cylinder 70 is formed from a clad material. For example, cylinder 70 may have clad portions (indicated by reference numeral 74) integrally formed or co-extruded with the other portion(s) of the cylinder 70, which can be formed from one or a combination of metals (precious metals, metal alloys, base metals), in accordance with one exemplary embodiment. The use of clad will decrease the amount of precious metal required to form cylinder 70. Clad can be formed on the outside or inside of the cylinder 70 depending on the application as shown in FIG. 9.

In accordance with one exemplary embodiment, the tip portion 40 of the cylinder 70 is also impacted to lock the cylinder 70 in place. The tip portion 40 of the cylinder 70 can be impacted at the same or different time as the shaft portion 42 of the cylinder 70. In accordance with one exemplary embodiment, the tip portion 40 of the cylinder 70 is impacted by the same impact head for the shaft portion 42 or by another impact head 76 of variable cross-section geometry driven by another force, which is indicated by arrow 78 in accordance with another exemplary embodiment. Another wedge-shape cross-section is formed at the tip portion 40 of cylinder 70 during impact, thus locking the cylinder in place. Of course the shape formed at the tip portion 40 can vary depending on the cross-section geometry of impact head 76. Once the tip portion 40 of the cylinder 70 is impacted, the tip portion 40 of cylinder 70 can further be coined as shown.

In accordance with yet another alternative exemplary embodiment of the present invention, the electrode tip 14 comprises a dual-rivet assembly 80 having a first rivet 82 and a second rivet 84. The first rivet 82 and the second rivet 84 each include a tip portion and a shaft portion. Specifically, the first rivet 82 has a tip portion 86 and a shaft portion 88 while the second rivet 84 has a tip portion 90 and a shaft portion 92. The shaft portions 88, 92 of both rivets are each inserted into opening 20. In this embodiment, shaft portion 88 of first rivet 82 is inserted into the opening from the first surface of the side wire 12 such that the tip portion 86 of the first rivet 82 is located on the first surface 26 and is secured to the side wire by engaging the flared portion 30. The tip portion 86 of the first rivet 82 is secured to the side wire by mechanical impact as described above. The shaft portion 92 of the second rivet 84 is inserted into the opening from the second surface of the side wire 12 so that the tip portion 90 of the second rivet 84 is facing the center electrode.

The first rivet 82 and the second rivet 84 are secured together through a resistance-welding process as described above in accordance with one exemplary embodiment. Of course, other means for securing the first rivet 82 to the second rivet 84 can be used in other exemplary embodiments of the present invention. In accordance with one exemplary embodiment, the head of tip portion 90 is coined to ensure the dual rivet assembly is locked in place.

Figure 11:
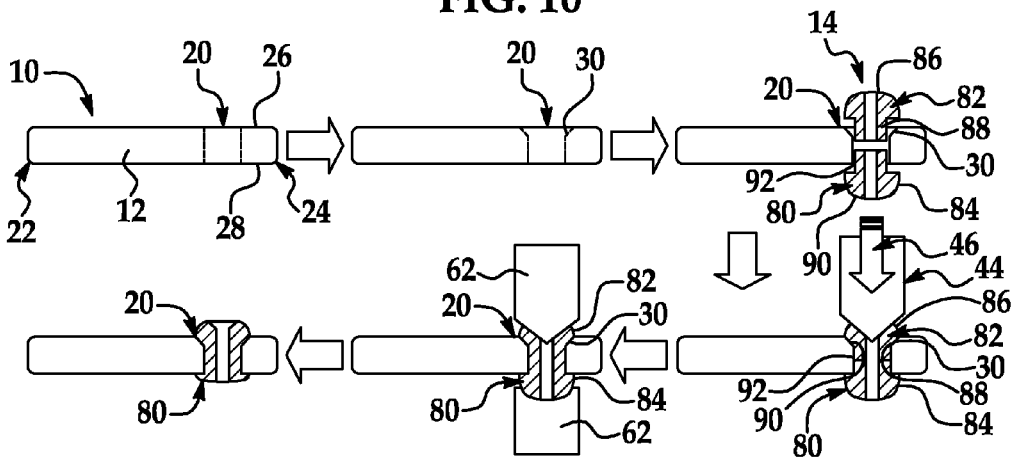

In accordance with one exemplary embodiment, the first rivet 82 and/or the second rivet 84 is formed from at least one precious metal, precious metal alloy, base metal or a combination thereof. For example, first rivet 82 and/or the second rivet 84 comprise of nickel, platinum, tungsten, iridium and/or rhodium. Of course, other combinations of metals (precious metals, precious metal alloys, base metals) can be used to form the first rivet 82 and/or the second rivet 84. In accordance with one exemplary embodiment, the first rivet 82 and/or the second rivet 84 includes a hollow core 94 as shown in FIG. 11. This would decrease the amount of precious metal required to form the dual-rivet assembly 80. The size of the hollow core 94 can vary depending on the application and is not limited to the size as shown.

Figure 12:
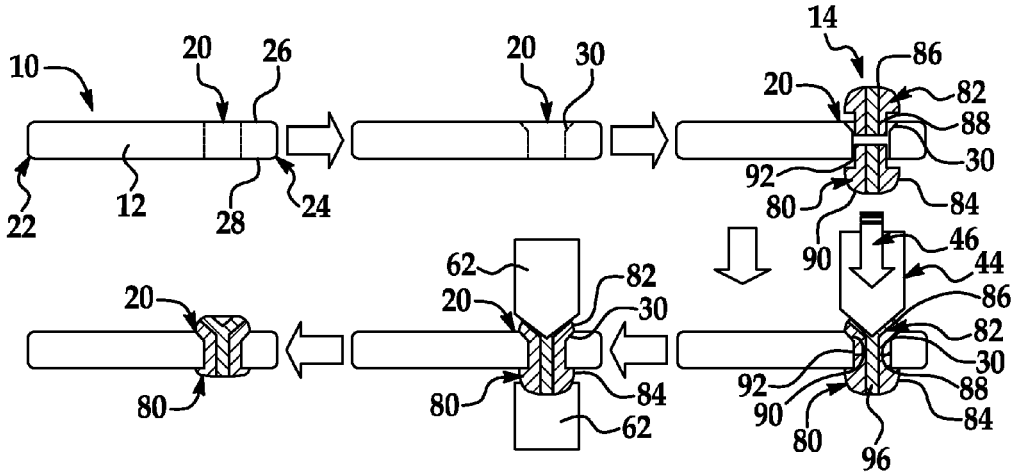

In accordance with one exemplary embodiment of the present invention, the first rivet 82 and/or the second rivet 84 may also comprise an additional material, such as clad. In other words, at least a portion of the first rivet 82 and/or the second rivet 84 is formed from a clad material. For example, the first rivet 82 and/or the second rivet 84 may have clad portions (indicated by reference numeral 96) integrally formed or co-extruded with the other portion(s) of the first rivet 82 and/or the second rivet 84, which can each be formed from one or a combination of metals (precious metals, metal alloys, base metals), in accordance with one exemplary embodiment. The use of clad will decrease the amount of precious metal required to form dual-rivet assembly 80. Clad can be formed on the outside or inside of the dual-rivet assembly 80 depending on the application as shown in FIG. 12.

Figure 13:
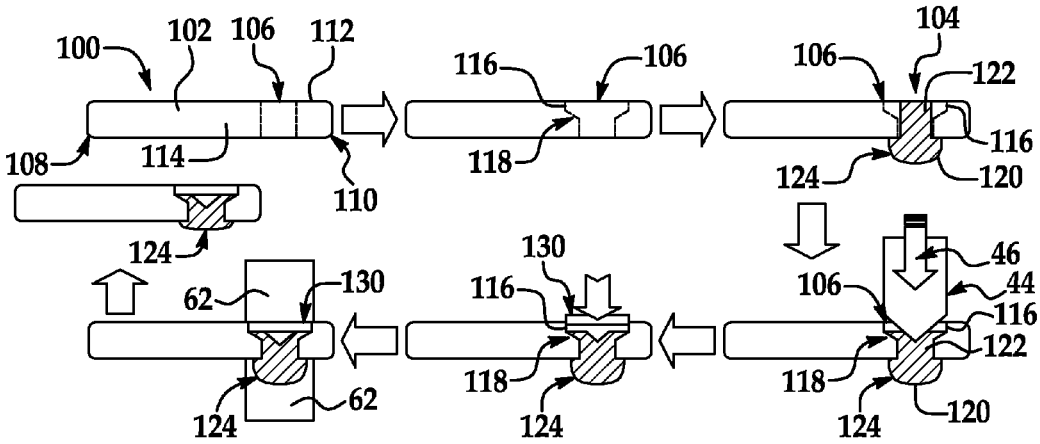
FIGS. 13-18 are side views of the side electrode with a side wire having a flange portion and a flared portion in accordance with an exemplary embodiment of the present invention.
Figure 14:
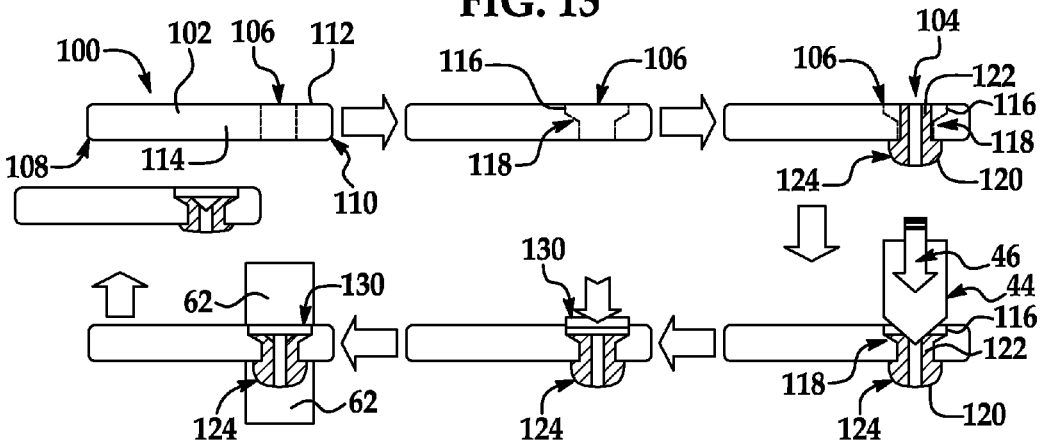
Figure 15:
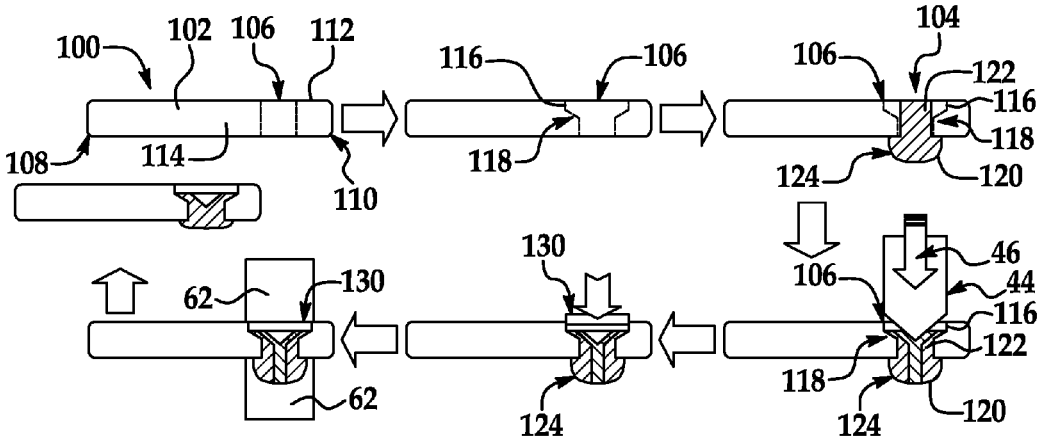
Figure 16:
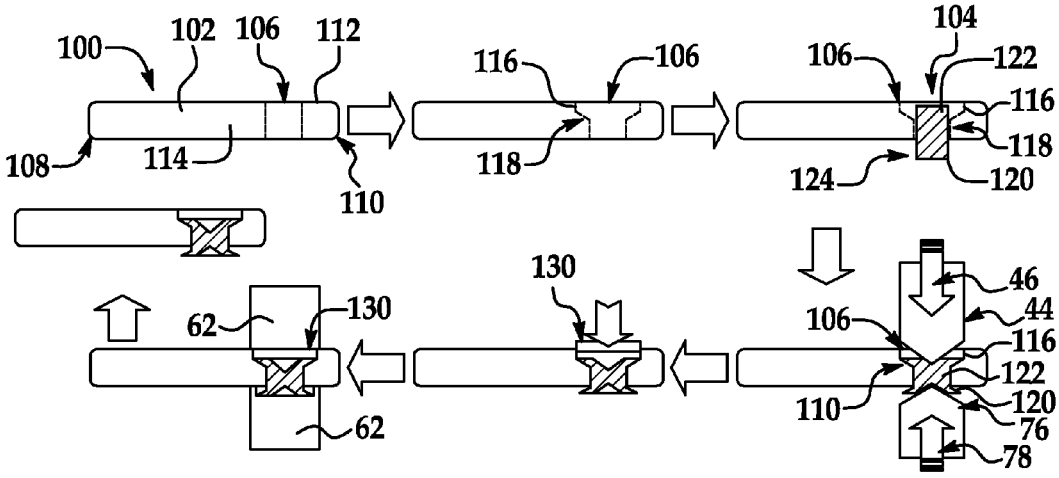
Figure 17:
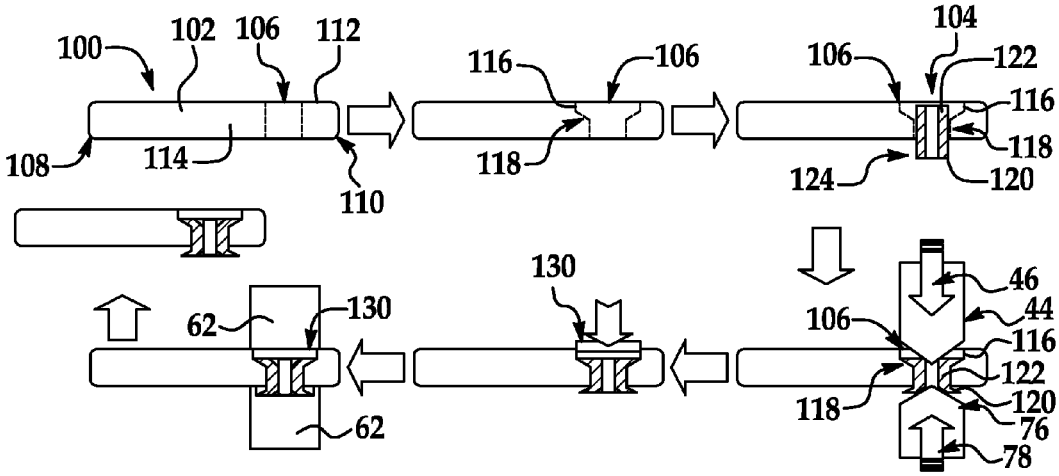
Figure 18:
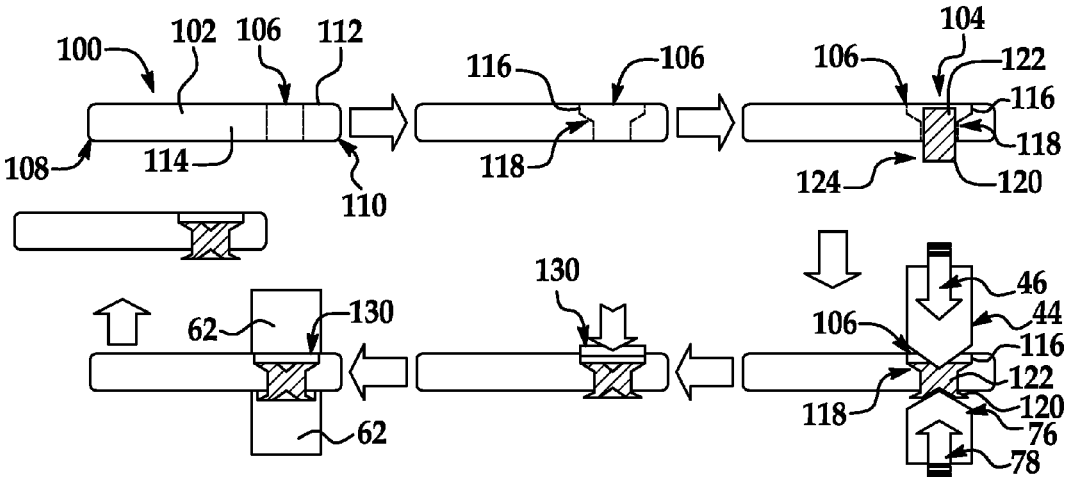

Referring now to FIGS. 13-18, a side electrode 100 is shown according to alternative exemplary embodiments of the present invention. As shown in FIG. 13, the side electrode 100 generally comprises a side wire 102 and an electrode tip 104 being secured to the side wire 102 through one or more means as described herein. In exemplary embodiments, the electrode tip 104 comprises a rivet, a hollow rivet, a cylinder, or a hollow cylinder.

In accordance with an exemplary embodiment of the present invention, the side wire 100 has an opening 106 for receiving an electrode tip 104. In accordance with one non-limiting exemplary embodiment, the opening 106 has a diameter close to that of the diameter of the narrow end/shaft of the electrode tip 104. The side wire 102 has a first end 108 and a second end 110. The opening 106 is proximate to the second end 110 of the side wire 102 and extends from a first surface 112 of the side wire 102 to a second surface 114 of the side wire 102. The first surface 112 of the side wire 102 has a flange portion 116 proximate to the opening 106 as shown. In one exemplary embodiment, the side wire 102 further includes a flared portion 118 located adjacent to the flange portion 116 and proximate to opening 106. The flange portion 116 has an inner diameter larger than the inner diameter of the flared portion 118 in accordance with one exemplary embodiment. In accordance with one exemplary embodiment, cutting, stamping, and/or drilling into the side wire 102 can form the opening 106, the flange portion 116, and the flared portion 118 of the side wire 102.

The side wire 102 is formed from one or more various types of super alloys, such as nickel-based alloys. Of course, other materials or a combination of materials can be used to form the side wire 102 and should not be limited to the example set forth herein.

In accordance with one exemplary embodiment, the electrode tip 104 has a tip portion 120 and a shaft portion 122. The tip portion 120 has a head portion 124. The shaft portion 122 is inserted into the opening 106 from the second surface 114 such that the shaft portion ends up at the flange portion 116 of the side wire 102 and the head of the tip portion 120 is facing the center electrode of a spark plug, in which the side electrode 100 can be incorporated into. In other words, the tip portion 120 of the electrode tip 104 is located on the second surface 114 of the side wire 102 and the shaft portion 122 is located at the flange portion 116 of the side wire 102 when the shaft portion 122 is inserted in the opening. The shaft portion 122 of the electrode tip 104 is secured to the side wire 102 by engaging the flared portion 118 as shown. In accordance with one embodiment, the shaft portion 122 of the electrode tip 104 is secured to the side wire 102 and engaged to flared portion 118 by impacting the shaft portion 122 as described above. Once the shaft portion 122 is engaged to the flared portion 118 a piece of side wire element or cylinder 130 is inserted into the flange portion 100 as shown in FIG. 13. In this embodiment, the side wire element 130 is secured to the side wire and/or the shaft portion 122 of the electrode tip. The side wire element 130 can be secured to the shaft portion of the electrode tip through a resistance welding process as described above. Of course, other means for securing the side wire element 130 to the side wire and/or the electrode tip can be used in other exemplary embodiments of the represent invention. The head of the tip portion can then be coined to ensure the electrode tip is locked in place. Coining as described herein can also provide a larger surface area uniformly distanced from the center wire and to accurately set the distance between the center and side electrodes.

In accordance with one exemplary embodiment, the side wire element 130 can be formed from the same or different material as the side wire 102. For example, the side wire element 130 and the side wire 102 can be formed from one or more various types of super alloys, such as nickel-based alloys. Of course, other materials or a combination of materials can be used to form the side wire element 130 and the side wire 102.

Any one of the electrode tip configurations as described above can be incorporated into side wire 102. In accordance with one exemplary embodiment, the electrode tip 104 comprises a rivet with varying configurations, such as the ones illustrated in FIGS. 13-15. Details of these varying rivet configurations are similar to the details for the rivet in FIGS. 1-3. In accordance with another exemplary embodiment, the electrode tip 104 comprises a cylinder with varying configurations, such as the ones illustrated in FIG. 16-18. Details of these varying cylinder configurations are similar to the details for the cylinder in FIGS. 7-9.

Figure 19:
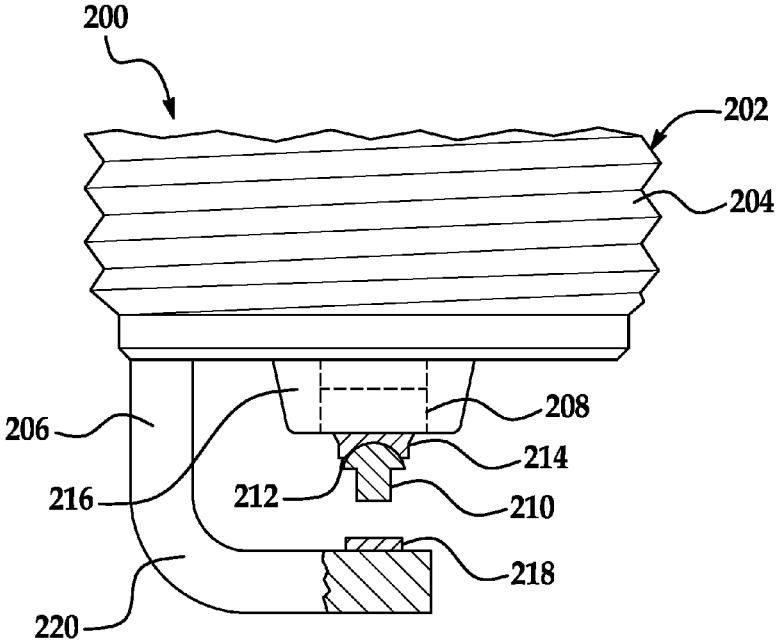
FIG. 19 is a cross-sectional view of an exemplary spark plug incorporating the side electrode in accordance with an exemplary embodiment of the present invention.

Referring now to FIG. 19, a spark plug generally indicated by numeral 200 includes an annular metal housing 202, which is threaded at 204 for installation into an internal combustion engine (not shown). A side electrode 206 extends from the housing 202 to define a firing gap with a center electrode 208. In one embodiment, the center electrode includes an electrode tip comprising a rivet 210 or sphere (not shown) of metal, which in one exemplary embodiment is formed from one of various platinum alloys and is secured to the end face 212 of an outer sheath 214 which projects from an insulator 216, which is mounted within the housing 202. In addition, the side electrode 206 includes an electrode tip 218 secured to a side wire 220 in accordance with one exemplary embodiment. It will be appreciated that electrode tip 218 can be configured to be any one of the electrode tips described above in accordance with exemplary embodiments of the present invention. It will further be appreciated that side wire 220 can be configured to be any one of the side wires described above in accordance with exemplary embodiments of the present invention.

In accordance with an exemplary embodiment, the electrode tip formed from rivet(s), cylinder(s), pads(s), and/or spheres can be formed from at least one precious metal, precious metal alloy, base metal or a combination thereof. Further, in exemplary embodiments of the present invention, the electrode tip can additionally comprise of a clad structure in which the precious metal is either inside or outside. In accordance with an exemplary embodiment, the second surface of the side wire can also be flared. Thus, either one or both surfaces of the side wire proximate the opening can be flared. It should be understood that the spark plug configuration in which the side electrode is incorporated into can vary depending on the application and should not be limited to the configuration described herein.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims and their legal equivalence.

What is claimed is:

1. A side electrode for a spark plug, comprising:

a side wire having a first end and a second end;

an opening proximate to the second end, the opening extending completely through the side wire from a first surface of the side wire to a second surface of the side wire, wherein the first surface is opposite to the second surface and wherein the opening has a flared portion proximate to the first surface of the side wire; and an electrode tip secured to the side wire, the electrode tip having a tip portion and a shaft portion, wherein the tip portion extends away from the second surface and the shaft portion is located in the opening and traverses from the first surface to the second surface and engages the flared portion of the opening.

2. The side electrode as in claim 1, wherein the electrode tip is a rivet.

3. The side electrode as in claim 1, wherein the electrode tip is a rivet with a hollow core shaft portion.

4. The side electrode as in claim 1, wherein the electrode tip is a cylinder.

5. The side electrode as in claim 1, wherein the electrode tip is a cylinder with a hollow core.

6. The side electrode as in claim 1, wherein the electrode tip is formed from at least a precious metal, a precious metal alloy, a base metal or a combination thereof.

7. The side electrode as in claim 1, wherein the shaft portion is impacted with an impact device to engage the shaft portion to the flared portion.

8. The side electrode as in claim 7, wherein the impact device is configured to form a cross-sectional shape on the shaft portion during impact.

9. The side electrode as in claim 1, wherein the tip portion is coined on the second surface.

10. The side electrode as in claim 1, wherein the tip portion is secured to the shaft portion by a resistance welding process.

11. A side electrode for a spark plug, comprising:

a side wire having a first end and a second end;

an opening proximate to the second end, the opening extending completely through the side wire from a first surface of the side wire to a second surface of the side wire, wherein the first surface is opposite to the second surface and wherein the opening has a flared portion proximate to the first surface of the side wire; and an electrode tip secured to the side wire, the electrode tip having a first member and a second member, the first member and the second member each having a tip portion and a shaft portion, wherein the tip portion of second member extends away from the second surface and the tip portion of the first member engages the flared portion of the opening.

12. The side electrode as in claim 11, wherein the first member is secured to the second member after they are separately inserted into the opening from opposite sides by a resistance welding process.

13. The side electrode as in claim 11, wherein the first member is a first rivet and the second member is a second rivet.

14. The side electrode as in claim 11, wherein the first member and the second member of the electrode tip are each formed from at least a precious metal, a precious metal alloy, a base metal or a combination thereof.

15. The side electrode as in claim 11, wherein the tip portion of the first member extends from the first surface and is impacted with an impact device to engage the tip portion of the first member to the flared portion.

16. A spark plug, comprising:

an insulator shell;

a center electrode disposed in the insulator shell such that one end of the center electrode protrudes from the insulator shell;

a metal shell exterior to the insulator shell;

a side electrode having a side wire with a first end coupled to the metal shell and a second end proximate to the protruding end of the center electrode forming a spark discharge gap therebetween, an opening proximate to the second end of the side wire, the opening extending completely h the side wire from a first surface of the side wire to a second surface of the side wire, wherein the first surface is opposite to the second surface and wherein the opening has a flared portion proximate to the first surface of the side wire; and an electrode tip secured to the side wire, the electrode tip having a tip portion and a shaft portion, wherein the tip portion extends from the second surface and the shaft portion is located in the opening and traverses from the first surface to the second surface and engages the flared portion of the opening and wherein the second surface faces the center electrode of the spark plug and the first surface does not face the center electrode of the spark plug.

17. The spark plug as in claim 16, wherein the electrode tip is a rivet.

18. The spark plug as in claim 16, wherein the electrode tip is a cylinder.

* * * * *